US005618159A

United States Patent [19]

Wilson

[11] Patent Number: 5,618,159

[45] Date of Patent: Apr. 8, 1997

[54] LIFT TRUCK FORK GUARD

[76] Inventor: Robert E. Wilson, 2308 Ridgestone Dr., Dallas, Tex. 75287

[21] Appl. No.: 658,900

[22] Filed: May 24, 1996

Related U.S. Application Data

[63] Continuation of Ser. No. 360,275, Dec. 21, 1994, abandoned.

[51] Int. Cl.[6] ..... B66F 9/12

[52] U.S. Cl. ..... 414/785; 187/237

[58] Field of Search ..... 414/785; 187/237

[56] References Cited

U.S. PATENT DOCUMENTS

| | | | |
|---|---|---|---|
| 2,282,201 | 5/1942 | Neuman | 414/785 X |
| 2,608,315 | 8/1952 | Turner | 414/785 X |
| 2,644,598 | 7/1953 | Winslow | 414/785 X |
| 2,956,701 | 10/1960 | Larson | 414/785 |
| 3,080,080 | 3/1963 | Miller | 414/785 |
| 3,145,863 | 8/1964 | Dunaski | 414/785 X |
| 3,625,385 | 12/1971 | Ide | 414/785 |
| 4,102,464 | 7/1978 | Schuster | 187/237 |
| 4,279,567 | 7/1981 | Thompson | 414/785 |
| 4,478,314 | 10/1984 | Dorman | 187/9 R |
| 4,652,037 | 3/1987 | Thau et al. | 296/73 R |
| 4,898,185 | 2/1990 | Fuller | 128/876 |
| 5,029,549 | 7/1991 | Armando | 114/361 |
| 5,056,869 | 10/1991 | Morrison | 297/485 |
| 5,072,979 | 12/1991 | Swinton | 293/128 |
| 5,221,176 | 6/1993 | Allan et al. | 414/785 |

*Primary Examiner*—David A. Bucci
*Attorney, Agent, or Firm*—Jay M. Cantor

[57] ABSTRACT

A protective guard for attachment to conventional lift trucks to prevent damage to transported materials caused by the hard surfaces and edges of lift forks is provided which comprises a flexible sheet having cushioning characteristics and having a width sufficient in length to span and cover the lift forks. The protective guard further comprises hook and loop type fasteners for attaching the flexible sheet to the lift truck such that the sheet covers the potentially damaging lift forks and allows for lateral movement of the lift forks.

15 Claims, 3 Drawing Sheets

FIG. 1
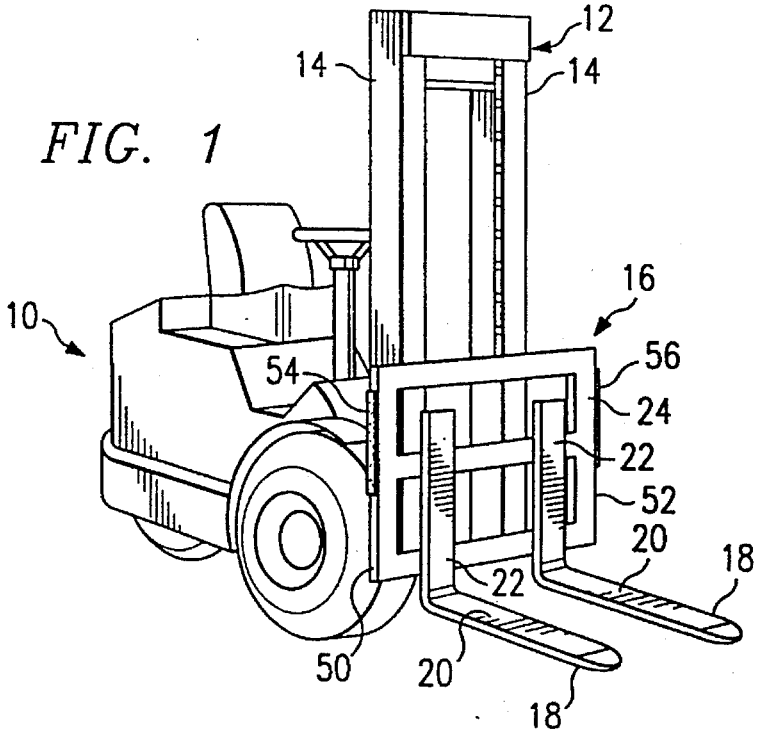
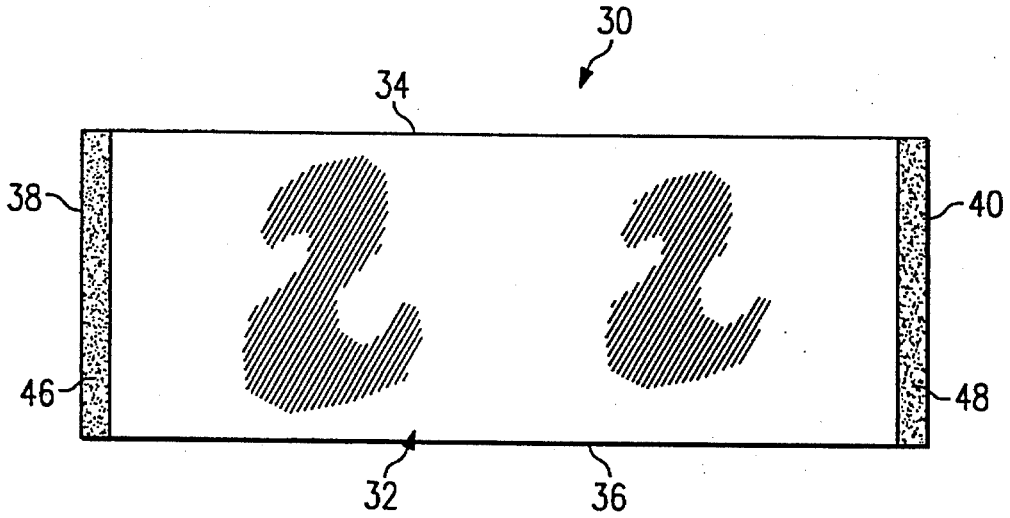
FIG. 2
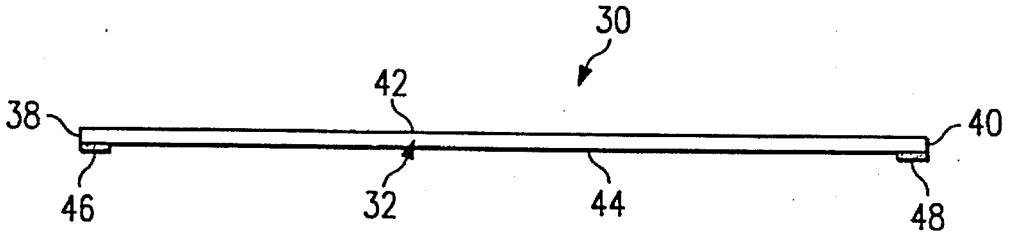
FIG. 3

LIFT TRUCK FORK GUARD

This application is a Continuation, of application Ser. No. 08/360,275, filed Dec. 21, 1994, now abandoned.

TECHNICAL FIELD OF THE INVENTION

The present invention relates to a flexible guard for attachment to industrial lift trucks to prevent damage to materials loaded, unloaded or transported with a lift truck.

BACKGROUND OF THE INVENTION

Industrial lift trucks, or forklifts as they are more commonly known, are routinely used in industrial and other applications to lift and transport materials from one location to another. Often times the materials to be transported are packaged in bags or boxes which are susceptible to breakage or damage upon loading or transporting due to contact with the hard surfaces of the forklift. It is known to equip forklifts with metal guards. However, such guards do not prevent damage to the packaging or its contents, but instead may cause damage.

Forklift damage to packaging and the contents thereof is particularly common and costly when handling edible materials. This is so because edible materials are often packaged in bags or boxes. Such damage not only results in an enormous amount of product loss, but also results in a significant amount of lost time due to the necessity of having to unstack and restack materials in order to dispose of the damaged materials.

A need exists for a device that protects packaging and materials from damage caused by contact with the hard surfaces of lift trucks during lifting and transportation. Furthermore, such protective device should be constructed such that the vision of the lift truck operator is not impaired.

SUMMARY OF THE INVENTION

The present invention provides a guard that can be easily attached to common forklifts to prevent damage to packaging and materials being lifted and transported. In the most common arrangement, a lift truck will include a pair of laterally spaced apart L-shaped lift forks extending from the front of the truck. Each fork has an upper, vertically extending portion secured to a carriage assembly which is vertically moveable on the truck.

In one aspect, the forklift guard of the present invention comprises a flexible sheet constructed of a material or materials which have adequate cushioning characteristics to prevent damage to transported materials. The sheet has a height defined between a top edge and a bottom edge and a width defined between a first end and a second end of the flexible sheet. The width of the sheet is sufficient in length to span the L-shaped fork members. Further included in this embodiment of the invention are means for attaching the flexible sheet to the carriage assembly, such that the guard covers at least a portion of the vertically extending portions of the lift forks. Preferably, the attachment means comprise hook and loop type fastener strips secured adjacent to each end of the flexible sheet, with the corresponding mating hook and loop fastener strip being secured to the carriage assembly such that the sheet can be attached to cover and span the vertical portion of the L-shaped fork members.

A further aspect of the present invention comprises such a sheet wherein the flexible material is vinyl.

An additional aspect of the present invention comprises the sheet having a height of about 1 to 4 feet.

These and other features and objects of the present invention can be best understood upon study of the attached specification and drawings, of which the following is a brief description thereof.

BRIEF DESCRIPTION OF THE DRAWINGS

For a more complete understanding of the present invention, and for further details and advantages thereof, reference is now made to the following description taken in conjunction with the accompanying drawings, in which:

FIG. 1 is a perspective view of a conventional fork lift apparatus;

FIG. 2 is a front perspective view of the protective guard detached from the forklift apparatus;

FIG. 3 is a top perspective view of the protective guard detached from the forklift apparatus.

DETAILED DESCRIPTION OF THE PREFERRED EMBODIMENTS

Figure 2A:
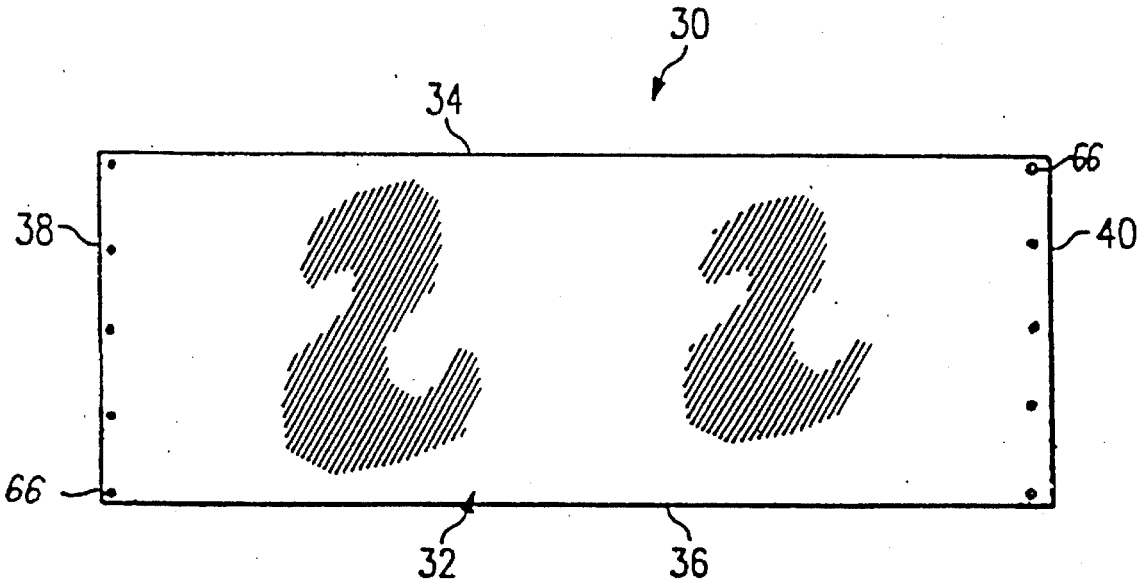
FIG. 2*a* is the same as FIG. 2 except that it includes snap fasteners.

Referring FIG. 1 there is shown a lift truck or forklift and components thereof, indicated generally by the numeral 10. A lifting frame is generally designated by numeral 12. Lifting frame 12 typically comprises a pair of laterally spaced upright members 14. Lift frame 12 further comprises a lift mechanism (not shown) which is operatively connected to lifting assembly 16 to raise and lower said assembly as desired. Conventional lift mechanisms for forklifts are shown in U.S. Pat. No. 2,956,701 and U.S. Pat. No. 4,478,314 the disclosures of which are hereby incorporated by reference. Other various lift mechanisms and configurations are used on commercially available lift trucks. The present invention is not limited to any particular lift truck design.

Lifting assembly 16 comprises a pair of laterally spaced lift forks 18. Lift forks 18 are shown to be generally L-shaped, each having a substantially horizontal portion 20 and a substantially vertical portion 22. In a typical lift truck, lift forks 18 can be moved and adjusted laterally for transport and lifting of various sized objects. As shown in FIG. 1 the lifting assembly further comprises a carriage assembly 24, typically made of metal, to which the vertical portions 22 of lift forks 18 are connected. The carriage assembly 24 is operably connected to the lifting mechanism for vertical movement relative to the lift truck. The carriage assembly 24 may also include other devices and attachments known in the field. For example metal guards or racks (not shown) are commonly attached to the carriage. Thus, reference to the carriage assembly herein is meant to include such attachments where applicable.

Figure 4:
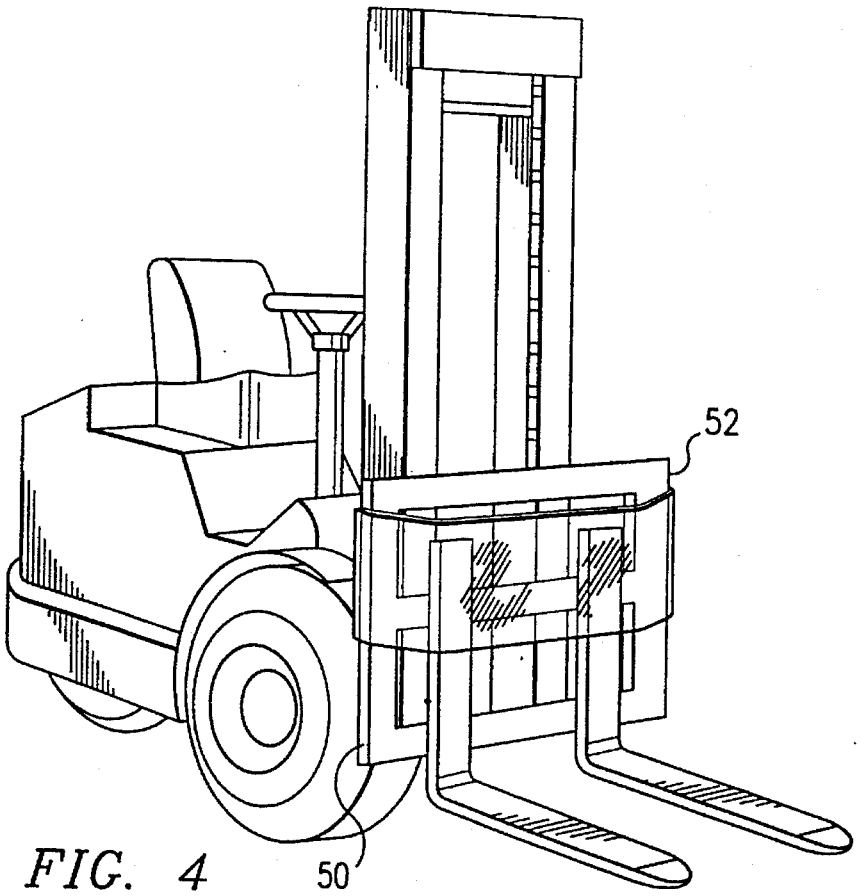
FIG. 4 is a front perspective view of the protective guard attached to the forklift apparatus.

With reference to FIGS. 2–4, the preferred embodiment of forklift guard 30 of the present invention is shown. Forklift guard 30 is adapted for attachment to a forklift to provide a protective guard which prevents damage to packaging and the contents thereof when lifting and transporting such materials. Forklift guard 30 comprises flexible sheet 32 made of a material which has adequate cushioning characteristics so as to protect packaged materials from the surfaces of the lift mechanism of a forklift. Most particularly, flexible sheet 32 protects packaging from damage commonly caused by the hard surfaces and edges of the vertical portions 22 of the lift forks 18 shown in FIG. 1. A number of materials which have sufficient cushioning characteristics may be used to form flexible sheet 32. For example, a preferred flexible, cushioning material is clear vinyl which is a readily available off the shelf product. Vinyl having a thickness of between about ⅛ to ½ inch has been found to provide suitable protection. It is recommended that the material used to form sheet 32 be at least partially transparent so that the vision of the forklift operator is not impaired by the protective guard.

Flexible sheet 32 has a height defined between top edge 34 and bottom edge 36, a width defined from first end 38 to second end 40, and a thickness defined between first face 42 and second face 44. Preferably the height of the sheet 32 should extend to cover at least the upper part of the vertical portions 22 of lift forks 18 (shown in FIGS. 1 and 4) since damage to transported materials is most often caused by the edges of the vertical portions 22 of the lift forks 18. A guard measuring between about 1 to 4 feet in height is typically suitable for achieving protective coverage over the lift forks. The width of sheet 32 should be of sufficient length to span the lift forks 18 and allow for attachment to the carriage assembly 24, as shown in FIG. 4. Typically, a sheet having a width of between about 3 to 5 feet will be suitable. Further, in the preferred embodiment, sheet 32 is generally rectangular in shape as shown in FIG. 2.

Referring again to FIGS. 2–4 there is shown the preferred means for attaching forklift guard 30 to the lift assembly 16 of a forklift. Strips 46 and 48 of Velcro hook and loop type fastening materials are attached adjacent to the first and second ends, reference numerals 38 and 40 respectively, of sheet 32 as shown in FIGS. 2 and 3. Velcro hook and loop type fastening materials are sold with an adhesive backing on each of the corresponding halves and therefore can be easily attached to sheet 32 and bracing carriage 24. In the exemplary embodiment of FIG. 4, there is shown guard 30 attached to carriage assembly 24. Mating strips of Velcro (numerals 54 and 56 in FIG. 1), which correspond to strips 46 and 48 attached to the sheet 32, are attached to the outwardly facing surfaces 50 and 52 of the carriage assembly 24 and are positioned such that the guard 30 will cover at least a portion of the vertically extending portions 22 of the lift forks 18, preferably the uppermost portion of the lift forks. The guard 30 is simply attached to the lift assembly by mating Velcro strips 46 and 48 with the corresponding mating strips 54 and 56 which are attached to the carriage assembly. Significantly, by attaching the guard 30 to the carriage assembly 24, rather than the lift forks 18, the lift forks are free to move laterally in their full range of movement.

Velcro hook and loop type fastening materials are representative of hook and loop type fasteners which are the preferred means for securing or attaching the guard to the carriage assembly. However, it should be appreciated that many other available means could also be used to removably attach guard 30 to the carriage assembly, for example snaps (shown as numeral 66 in FIG. 2A). The guard 30 could also be attached to the carriage assembly by providing holes in sheet 32 adjacent to ends 38 and 40, through which self-tapping screws may be placed. It may also be possible to use magnetic strips in place of hook and loop type fastener strips.

Figure 5:
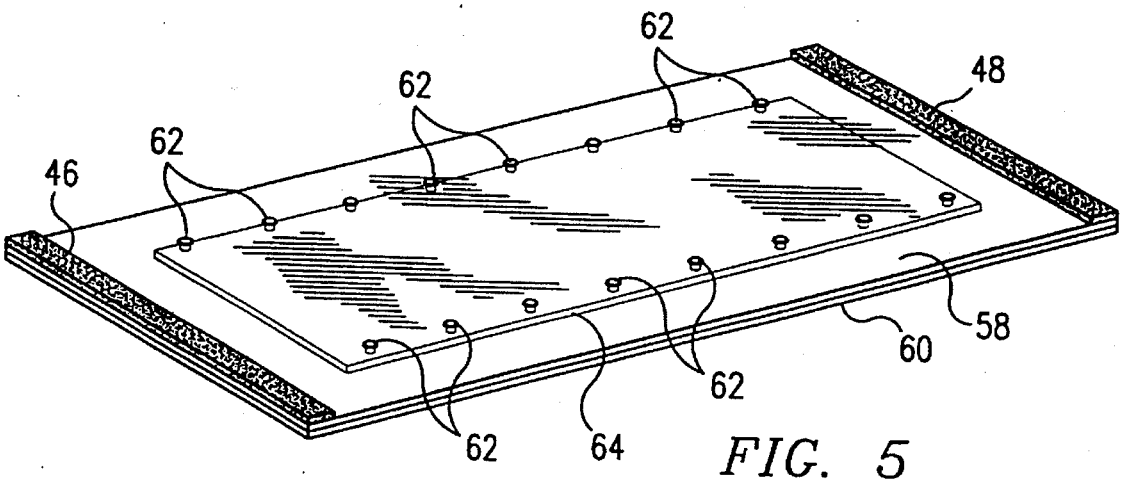
FIG. 5 is a front view perspective of an alternative embodiment of the protective guard.

It has been found that with certain lift truck configurations a flexible vinyl sheet will require additional rigidity to suitably attach to the lift truck. As shown in FIG. 5, one way to achieve this additional rigidity while maintaining flexibility of the guard is to construct the guard by stacking two or more flexible sheets, preferably made of vinyl (see reference numerals 58 and 60). Multiple vinyl sheets will also enhance the cushioning characteristics of the guard. In the embodiment shown in FIG. 5 flexible sheets 58 and 60 have substantially the same dimensions. The sheets may by attached to each other in a stacked relationship by any available means, such as rivets 62 or adhesives (not shown). Further referring to FIG. 5, additional rigidity in the guard 30 can be achieved (while still maintaining flexibility) by disposing a more rigid third flexible sheet 64 between the two flexible sheets 58 and 60. A preferred material for the third flexible sheet 64 is LEXAN. Again, the stacked sheets 58 and 60 with the third flexible sheet 64 disposed therebetween can be attached in a stacked relationship using any available means, most preferably rivets 62, as shown.

Although the present invention has been described with respect to a preferred embodiment, various changes, substitutions and modifications of this invention may be suggested to one skilled in the art, and it is intended that the present invention encompass such changes, substitutions and modifications as fall within the scope of the appended claims.

I claim:

1. A protective guard for a lift truck having a pair of laterally spaced apart L-shaped forks extending therefrom, each fork having an upper, vertically extending portion secured to a carriage assembly which is vertically moveable on said truck and a lower, horizontally projecting portion for engaging a load thereover, said vertically extending portion and said horizontally extending portion of each of said L-shaped forks collectively securing said load thereagainst from movement and lifting and lowering said load over said horizontally projecting portion, said protective guard comprising:

(a) a first flexible sheet having a height defined between a top edge and a bottom edge and a width defined between a first end and a second end, said width of said first flexible sheet being sufficient in length to span said vertical extending portions of said lift forks;

(b) said first flexible sheet being made of a material which has cushioning characteristics to reduce or prevent damage to materials being transported on said lift truck caused by contact with said lift forks, said first flexible sheet further being transparent so as to allow a lift truck operator to see through said first flexible sheet;

(c) said first flexible sheet disposed against said vertically extending portion; and (d) releasable fastening means disposed on said first flexible sheet and said carriage assembly for releasably attaching said first flexible sheet to said carriage assembly such that said first sheet spans at least a portion of each of said vertically extending portions of said lift forks.

2. The invention as defined in claim 1 wherein said first flexible sheet comprises a vinyl material.

3. The invention as defined in claim 1 wherein said height of said first flexible sheet is sufficient to substantially cover said vertically extending portions of said lift forks.

4. The invention as defined in claim 1 wherein said attaching means comprise hook and loop type fasteners.

5. The invention as defined in claim 1 wherein said attaching means comprise snap type fasteners.

6. The invention as defined in claim 2 wherein said first flexible sheet has a thickness between about ⅛ inch and about ½ inch.

7. The invention as defined in claim 2 wherein said attaching means comprise hook and loop type fasteners.

8. The invention as defined in claim 1 wherein said height of said first flexible sheet measures between about 1 to about 4 feet.

9. The invention as defined in claim 1 wherein said first flexible sheet is substantially rectangular in shape.

10. The invention as defined in claim 1 further comprising a second flexible sheet having substantially the same dimensions as said first flexible sheet, said first and second flexible sheets being attached together in a stacked relationship.

11. The invention as defined in claim 10 further comprising a third flexible sheet disposed between said first and second flexible sheets, said third flexible sheet being constructed of a material which is more rigid than said first and second flexible sheets.

12. The invention as defined in claim 2 further comprising a second flexible sheet constructed of a vinyl material and having substantially the same dimensions as said first flexible sheet, said first and second flexible sheets being attached together in a stacked relationship.

13. The invention as defined in claim 12 further comprising a third flexible sheet disposed between said first and second flexible sheets, said third flexible sheet being constructed of a material which is more rigid than said first and second flexible sheets.

14. A protective guard in combination with a lift truck, said lift truck having a pair of laterally spaced apart L-shaped lift forks extending therefrom, each fork having an upper, vertically extending portion secured to a carriage assembly which is vertically moveable on said truck and a lower horizontally projecting portion for engaging a load thereover, said vertically extending portion and said horizontally extending portion of each of said L-shaped forks collectively securing said load thereagainst from movement and lifting and lowering said load over said horizontally projecting portion, said protective guard comprising a first flexible sheet having a height defined between a top edge and a bottom edge and a width defined between a first end and a second end, said width of said first flexible sheet being sufficient in length to span said vertical extending portions of said lift forks, said first flexible sheet being made of a material which has cushioning characteristics to reduce or prevent damage to materials being transported on said lift truck caused by contact with said lift forks, said first flexible sheet further being transparent so as to allow a lift truck operator to see through said first flexible sheet;

(c) said first flexible sheet disposed against said vertically extending portion; and (d) releasable fastening means disposed on said first flexible sheet and said carriage assembly for releasably attaching said first flexible sheet to said carriage assembly such that said first sheet spans at least a portion of each of said vertically extending portions of said lift forks.

15. The invention as defined in claim 14 wherein said first flexible sheet comprises a vinyl material.

* * * * *